US005769259A

United States Patent [19]

Revill et al.

[11] Patent Number: 5,769,259

[45] Date of Patent: Jun. 23, 1998

[54] FULL-OPEN END PANEL FOR CONTAINER CLOSURE

[75] Inventors: Peter Lewis Revill, St Kilda; Alan George Dalli, Warrandyte; Dietmar Salm, Austinmer; James Douglas Peck, Hawthorn, all of Australia

[73] Assignee: The Broken Hill Proprietary Co Ltd, Melbourne, Australia

[21] Appl. No.: 700,360

[22] PCT Filed: Mar. 2, 1995

[86] PCT No.: PCT/AU95/00104

§ 371 Date: Nov. 12, 1996

§ 102(e) Date: Nov. 12, 1996

[87] PCT Pub. No.: WO95/23741

PCT Pub. Date: Sep. 8, 1995

[30] Foreign Application Priority Data

Mar. 2, 1994 [AU] Australia ..... PM4194

[51] Int. Cl.[6] ..... B65D 17/52

[52] U.S. Cl. ..... 220/284; 220/277; 220/265; 220/266; 220/268

[58] Field of Search ..... 220/284, 277, 220/276, 265, 266, 268; 215/295, 302, 303

[56] References Cited

U.S. PATENT DOCUMENTS

| | | | |
|---|---|---|---|
| 794,880 | 7/1905 | Page | 220/284 |
| 801,683 | 10/1905 | Penfold . | |
| 1,672,722 | 6/1928 | Mason | 220/284 |
| 2,210,225 | 8/1940 | Walensky . | |
| 3,362,570 | 1/1968 | Geiger . | |
| 3,759,206 | 9/1973 | Dalli et al. | 220/268 X |
| 3,931,909 | 1/1976 | Dalli et al. | 220/268 |
| 3,948,415 | 4/1976 | Debenham | 220/266 X |
| 4,003,495 | 1/1977 | Grise et al. . | |
| 4,020,969 | 5/1977 | Ando . | |
| 4,102,304 | 7/1978 | Debenham . | |
| 4,151,314 | 4/1979 | Debenham . | |
| 4,155,480 | 5/1979 | Debenham et al. | 220/268 |
| 4,375,861 | 3/1983 | Jepsen . | |
| 4,842,469 | 6/1989 | Schmidt . | |
| 5,048,713 | 9/1991 | Tiveron . | |
| 5,307,949 | 5/1994 | Von Holdt, Jr. . | |

FOREIGN PATENT DOCUMENTS

| | | | |
|---|---|---|---|
| 2 276192 | 2/1993 | Australia . | |
| 1 063537 | 10/1979 | Canada . | |
| 0 377788 | 7/1990 | European Pat. Off. . | |
| 553514 | 8/1993 | European Pat. Off. . | |
| 1 443829 | 9/1966 | France . | |
| 57579 | 2/1990 | Japan | 220/284 |
| 1 474608 | 5/1977 | United Kingdom . | |
| 93/01096 | 1/1993 | WIPO | 220/276 |

OTHER PUBLICATIONS

Patent Abstracts of Japan M973, p. 78, JP 2–57579(A), Feb. 27 1990.

*Primary Examiner*—Allan N. Shoap
*Assistant Examiner*—Robin A. Hylton
*Attorney, Agent, or Firm*—Dennison, Meserole, Pollack & Scheiner

[57] ABSTRACT

An end panel for a full-open end closure for a container comprising a rim portion, a removable central panel portion connected to the rim portion for detachment by an opening implement, an array of closely spaced push-in closure members dimensioned and spaced to receive the prongs of a standard domestic fork as the opening implement. The closure members are in a generally linear array adjacent the rim portion and the fork engages the openings defining the closure members and is levered against the rim to remove the central panel portion from the rim. Alternatively, the closure members are in a radial linear array extending towards the center of the central panel portion with the outermost closure member adjacent the rim portion so that the central panel portion can be conveniently levered from the rim portion without the need for a special opening implement.

14 Claims, 3 Drawing Sheets

2
3
5
6
7
8
10
11
13
20
21
S

FULL-OPEN END PANEL FOR CONTAINER CLOSURE

FIELD OF THE INVENTION

This invention relates to closures for containers, such as cans for food products including pet foods, and more particularly to closures of the full-open end type in which substantially all of the end panel is removed when the closure is opened.

BACKGROUND OF THE INVENTION

Most full-open ends currently in use include an end panel which is scored or weakened along a line extending adjacent the rim of the end, which is seamed to the can body. Examples of typical full-open end closures of the above types may be found in the patent literature, and it will be noted that closures of this type usually require a retained ring-pull/lever mechanism by means of which the initial rupturing of the score line is achieved. Such opening devices are often difficult to manipulate, requiring considerable force to be applied to cause the initial rupturing of the score line. Additionally, the retained lever mechanism must be separately formed and must be attached to the end penal by some form of rivet.

In our International Patent Applications Nos. PCT/AU92/00337 published 18 Feb. 1993 as WO 93/02932 and PCT/AU92/00338 published 21 Jan. 1993 as WO 93/01096, we describe a full-open end construction in which a central end panel is sealingly received between a pair of folds in a rim portion thereby avoiding the disadvantages of a full-open end which must be severed along a score line. Also described is a push-in closure construction shaped to receive an opening implement such as a spoon to enable the central panel to be opened either along a score line or by removal of the panel edge from between the pair of folds. This arrangement has the advantage over other constructions which are opened by implements such as spoons in that a central locating abutment is provided to prevent withdrawal of the spoon from the closure during the opening operation.

To facilitate opening by means of a spoon the push-in closure must be of sufficient size to accept a spoon of at least dessert spoon size since otherwise the necessary leverage and strength characteristics will not be present. One of the consequences of a push-in closure of these dimensions is that containers which must be subjected to sterilization or other processing, such as those containing food products including pet foods, are subjected to increases in external and internal pressure which may result in the container end losing its structural integrity in the region of the push-in closure. For example, in the case of pet foods the cooking/sterilization process subjects the can and the end to an external pressure of about 170 kPa and to an increased internal pressure of about 250 to 270 kPa.

SUMMARY OF INVENTION AND OBJECT

It is the object of the present invention to provide an end panel for a full-open end closure for a container in which a modified push-in closure construction enables the use of an opening implement having one or more relatively narrow pointed elements.

The invention provides an end panel for a full-open end closure for a container, comprising a rim portion, a removable central panel portion connected to the rim portion for detachment by means of an opening implement, said central panel portion having at least one push-in closure member dimensioned to receive a small narrow portion of an opening implement, said push-in closure member comprising a tab portion severable from the central panel to create an opening dimensioned to receive said narrow portion without materially affecting the structural integrity of the end panel under high pressure conditions, means hermetically sealing the tab portion to the central panel portion, said tab portion being displaceable by said narrow portion of said opening implement to create an opening not substantially larger than said narrow portion of said opening implement to thereby allow firm engagement between said opening implement and said central panel and enable detachment of said central panel portion from said rim portion By forming one or more push-in closures of small dimensions in the central panel portion, a narrow member of an opening implement, such as the prong of a fork, may be used to penetrate the central penal to thereby securely engage the central panel to enable it to be levered from the rim. By restricting the dimensions of the push-in closure member(s), the structural integrity of the end panel will not be compromised under high internal pressure conditions whilst still allowing the central panel portion to be removed from the rim in a simple operation using a convenient and available implement.

The central panel portion may be integrally formed with the rim portion for subsequent separation along a score line as known in the art. The formation of one or more small push-in closure members in the central panel portion is a significantly less demanding and costly process than the formation and attachment of a ring-pull lever of known construction, thereby significantly reducing the cost of providing a full-open end in a container.

Alternatively, the central panel portion may be connected to the rim portion in the manner disclosed in International Patent Application No. WO 93/02932. In the formation of this form of closure, the central panel portion is left connected in the rim portion by small tags of metal so that the central panel portion remains connected to the rim portion until the edge of the central panel is located in the folded rim portion.

In a preferred form of the invention, a substantially linear array of small push-in closure members is formed in the central panel. For example, an array of four closure members spaced and dimensioned to receive the prongs of a standard domestic fork has been found to be useful.

In one form of the invention, the linear array is oriented to be along a line generally parallel to the rim with the fork engaging the rim as the central panel is levered from the rim portion. In this arrangement, the array will be slightly arcuate to follow the shape of the rim, although the array may be positioned inwardly of the rim in which event it would be substantially linear.

Alternately, the array of closure members is arranged generally radially of the central penal with the outermost closure member in the array being adjacent the rim. Tests have shown that this orientation maximises the retention of the central panel on the fork when the central panel is removed and does not detract from the users ability to lever the central panel from the rim, whether the central panel is of fully severed on scored construction.

The small push-in closure member(s) are preferably generally rounded in shape and are each dimensioned so as to closely receive the narrow portions of an opening implement, such as the prongs of a standard domestic fork. Alternatively, one or more narrow oval push-in closure member(s) can be formed in the central panel to receive two or more of the prongs of a fork or similar implement.

Each closure tab portion may be formed within a depressed region defined by a sloping side wall surrounding each tab portion so as to guide the narrow portion of the opening implement into engagement with the closure tab portion. If desired, the central closures may be formed in slightly deeper depressed regions so that the outermost closures are engaged and opened by the opening implement first. In this way only two of the closures are initially opened thereby reducing the opening force required to be applied by the opening implement. Alternatively, the central two closures may be formed in a depressed region of the central panel portion so that the outer prongs of the fork initially engage the outermost closures followed by engagement of the innermost closures so that alignment of the fork prongs with the closures is less of a problem.

Each closure tab portion may be formed with a central depression or indentation so as to guide the narrow portion of the opening implement into engagement with the closure tab portion.

The push-in closure tab(s) are preferably severed from the central panel portion, except for a narrow neck of metal defining a hinge, and the tabs are at least partially overlapping and underlying an edge portion of the panel surrounding the opening produced by the severed tab. Such push-in closures may take any one of the forms, and be produced by any one of the methods, described in our U.S. Pat. Nos. 3759206, 3931909 and 4155480, the contents of which are incorporated into this specification by cross reference. Alternatively, the push-in closure tab(s) may be defined by a score line which is ruptured by penetration of the opening implement through the central panel portion in the region of the tab.

The central panel is preferably formed with a raised bead ring having a sloping inner wall positioned to engage the tips of the fork prongs to correctly locate the fork during the levering operation.

The central panel is formed with any suitable pattern of bead rings to suitably strengthen the panel against buckling during processing and handling of the can. A downwardly directed bead ring is preferably positioned outwardly of the closures to strengthen the central panel against external pressure, and a pair of upwardly extending beads are formed inwardly of the closures to strengthen the central panel against internal pressure. The raised bead ring referred to above is preferably the innermost bead ring of said pair.

The configuration of the bead rings may be modified from the standard circular shape, particularly in the region of the closures, to encourage the panel to deform appropriately as the opening implement is levered against the rim of the can.

BRIEF DESCRIPTION OF THE DRAWINGS

Two presently preferred embodiments of the invention will now be described with reference to the accompanying drawings in which.

DESCRIPTION OF PREFERRED EMBODIMENTS

Figure 1:
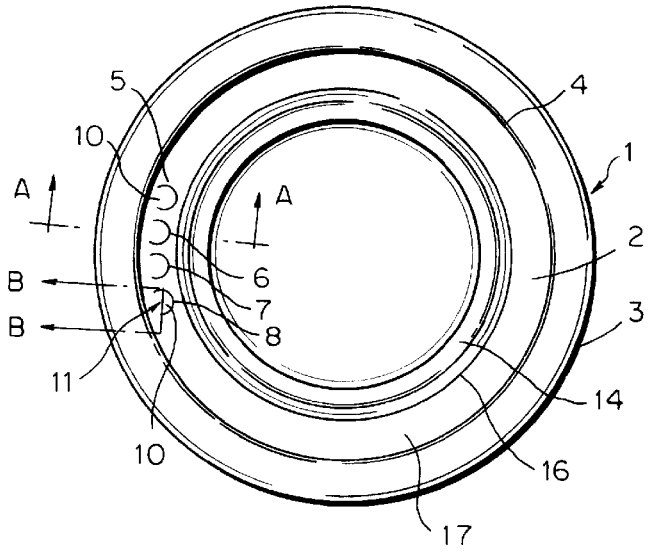
FIG. 1 is a plan view of a can end incorporating the improved easy-opening feature of the present invention.
Figure 2:
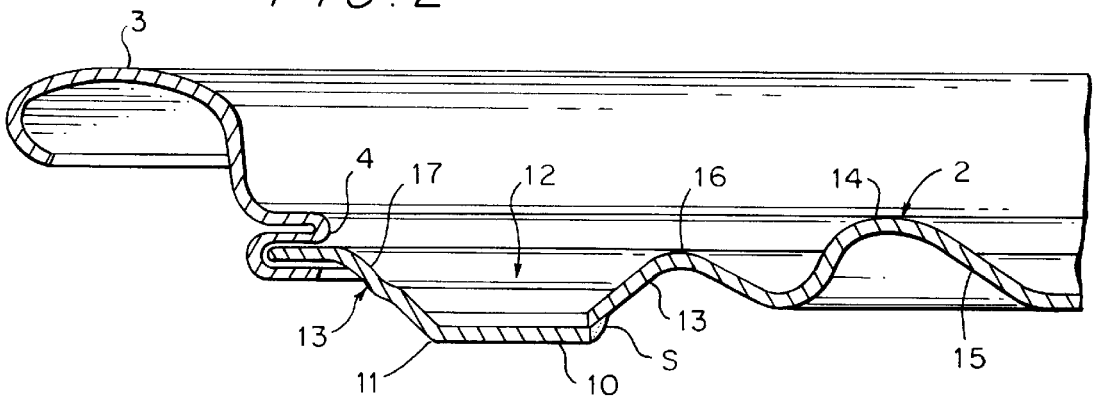
FIG. 2 is a fragmentary sectional elevation taken along the line A—A in FIG. 1.
Figure 3:
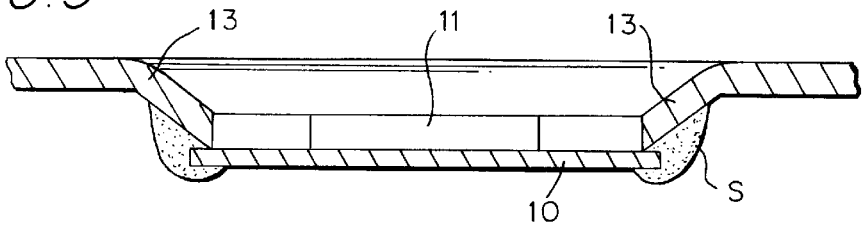
FIG. 3 is a fragmentary sectional elevation taken along the line B—B in FIG. 1.

In the preferred embodiment shown in the drawings, the closure comprises a can end 1 suitable for closing a container for food products, including pet foods. The can and 1 comprises a central panel 2 and a rim 3 which are connected in the manner shown in FIG. 2 and as described in greater detail in our International published patent application Ser. No. WO 93/02932. The central panel 2 and the rim 3 may be integrally connected with the central panel 2 being capable of detachment from the rim 3 along a score line along the line 4. The manner in which the central panel 2 is connected to the rim 3 is not relevant to the present invention and will not therefore be further described in the present specification.

The central panel 2 is formed with an array of generally circular push-in closures 5 to 8 each comprising a severed tab 10 connected to the panel 2 by a narrow neck 11 of metal defining a hinge, the severed tab 10 defining an opening 12. Each tab 10 is positioned in a plane which is displaced immediately below the plane of the adjacent metal of the panel 2 (FIG. 2), and the tabs 10 are preferably enlarged so that at least a portion of the free edge of each tab is in underlying relationship with the metal adjacent the opening 12. Each tab 10 is hermetically sealed with respect to the central panel 2 by means of a plastisol sealant S applied in any suitable manner to the inner face of the can end 1, such as in the manner described in our U.S. Pat. Nos. 4102304, 4151314 and 4842469.

The overlapping relationship of each tab 10 with respect to the edge portions of the panel surrounding each opening 12 may be achieved in various manners, including cold working of the metal of each tab (e.g. coining), or by forming a downwardly directed bulge in the tab 10 and at least partially flattening that bulge during the formation of each push-in closure 5 to 8. Examples of methods of forming push-in closures will be found in our U.S. Pat. Nos. 3759206, 3931909 and 4155480. In any event, each tab 10 is preferably formed within a small central downwardly depressed region 12 defined by a sloping wall 13 surrounding each closure 5 to 8 so that the opening implement may be more easily located as will be described further below.

Figure 4:
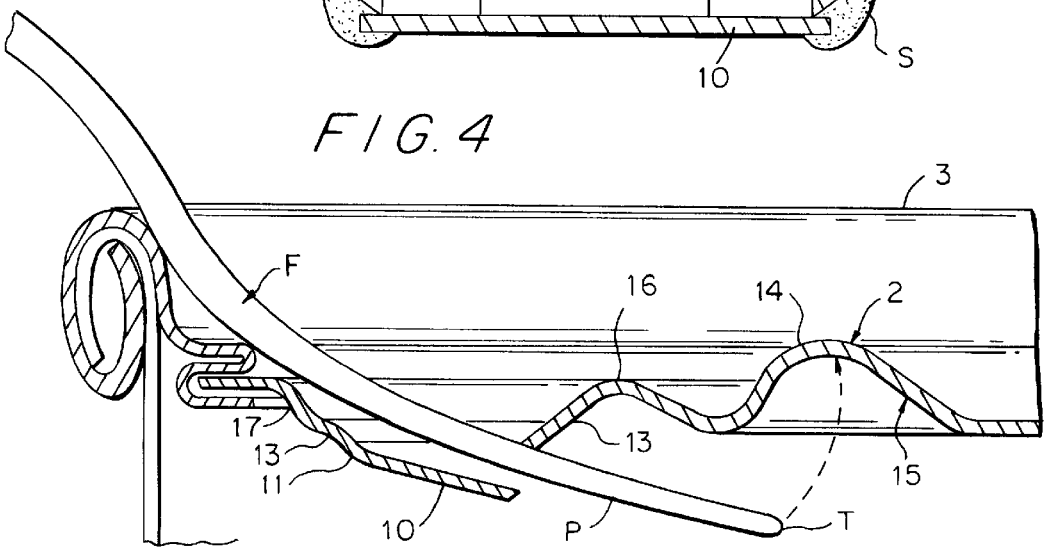
FIG. 4 is a schematic sectional elevation showing a domestic fork engaged with the closures in the end to facilitate opening.
Figure 7:
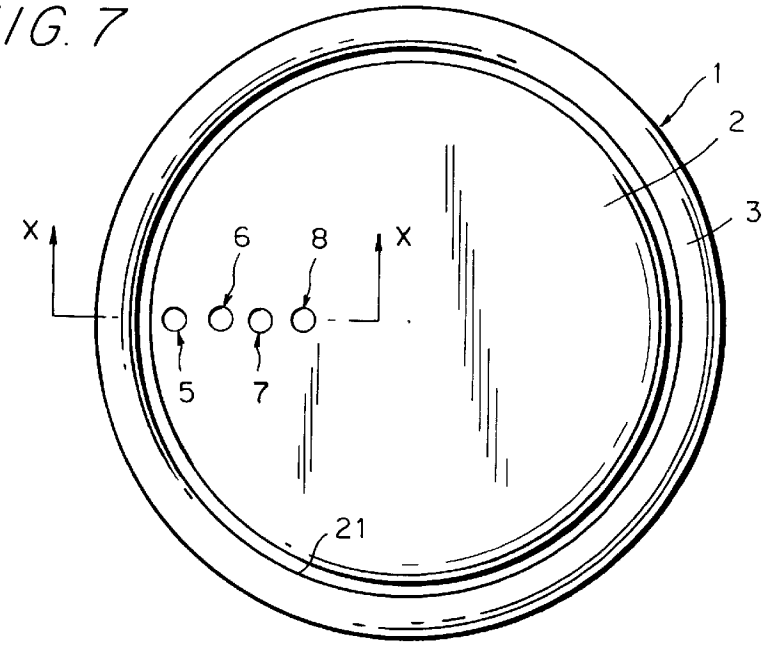
FIG. 7 is a plan view of a can end incorporating a further embodiment of the improved easy-opening feature of the present invention.

The push-in closures 5 to 8 are dimensioned and spaced to receive the prongs P of a typical domestic fork F, as shown further in FIG. 4 of the drawings, with the sloping wall 13 adjacent the rim 3 serving to guide each prong P towards engagement with the tab 10. Each opening 12 may be about 3.5 millimeters in diameter with the spacing between the outermost closures 5 and 8 being at about 16 millimeter centres, and the central closures 6 and 7 being spaced at about 5 millimeter centres. If desired, the central closures 6 and 7 can be positioned slightly lower (about 0.2 to 0.5 mm) than the closures 5 and 8 so that the fork prongs P penetrate the closures 5 and 8 first.

Figure 5:
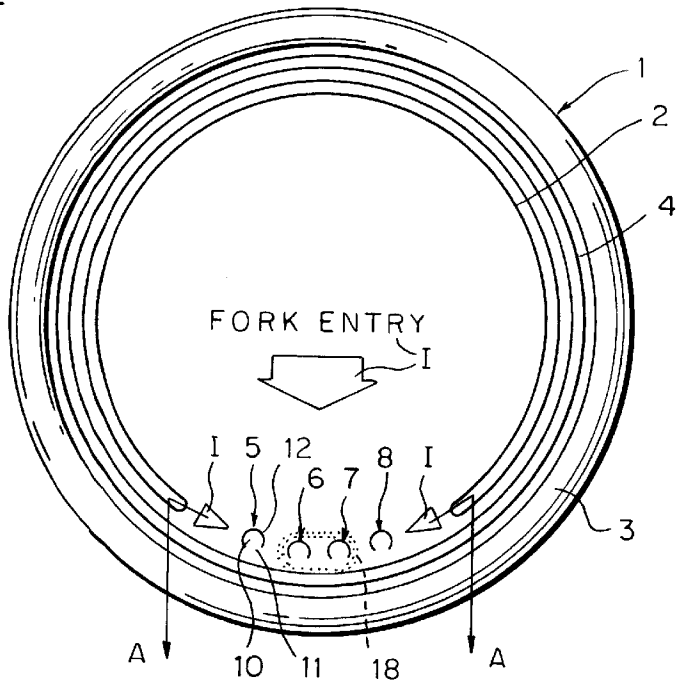
FIG. 5 is a plan view of another can end incorporating the improved easy-opening feature of the present invention.

The closures 5 to 8 are arranged along a slightly arcuate line corresponding to the curvature of the can end 1 at the location selected adjacent the line 4 between the central panel 2 and the rim 3. If desired, indicia I, for example as shown in FIG. 5, may be formed in the can end or applied to the can end to indicate the point of entry of the opening implement.

The central panel 2 is formed with a pattern of bead rings including an enlarged inner bead ring 14 which has a sloping inner wall 15 against which the tips T of the prongs P engage as the fork F is levered against the rim 3. If the prongs P have been inserted too far through the closures 5 to 8, this engagement between the tops T and the sloping wall 15 will tend to relocate the fork F so that the available leverage is not minimised.

A further bead ring 16 is formed adjacent the closures 5 to 8, and this head ring 16, in combination with bead ring 14, strengthens the central panel 2 against buckling under internal pressure caused by processing, allowing about 7 mm of outward expansion of the central panel 3 without distortion.

An inwardly directed bead ring 17 is formed between the closures 5 to 8 and the rim 3, and forms part of the side wall 13 around each closure. This bead ring 17 reinforces the central panel against external pressure during processing and allows about 3 mm of inward flexing of the central panel 3 without distortion.

By providing several small discrete push-in closures 5 to 8, the structural integrity of the can end 1 is not materially affected and the contents of the container may be subjected to any desired processing which significantly elevates the internal pressure within the container. By forming an array of small dimension push-in closures 5 to 8 dimensioned and spaced in a manner with facilitates penetration of the central panel 2 by means of the prongs of a domestic fork, the can end 1 is still able to be easily opened by means of a convenient implement which does not require a lengthy opening operation of the type needed in the case of known can openers. Thus, the convenience of the type of opening operation described in our International Patent Applications referred to above is maintained whilst ensuring the structural integrity of the can end 1 during processing operations.

The shape of the openings 12 of the closures 5 to 8 is unimportant to the present invention, and any desired opening shape may be adopted, e.g., rectangular, square, triangular, oval or any other desired polygonal or complex shape. While it is desirable that there be overlap between the closure tab 10 and the central panel 2 surrounding the opening 12, an unexpanded severed tab 10 in combination with the applied sealant S would be likely to exhibit sufficient structural integrity to satisfy processing requirements. Certainly the amount of overlap need only be quite small and is easily achieved by the known methods described above. Similarly, while the formation of a severed push-in closure of the type described above is preferred, an acceptable result may be provided by the use of score lines, or similar weakening devices known in the art, defining the push-in closures.

Figure 6:
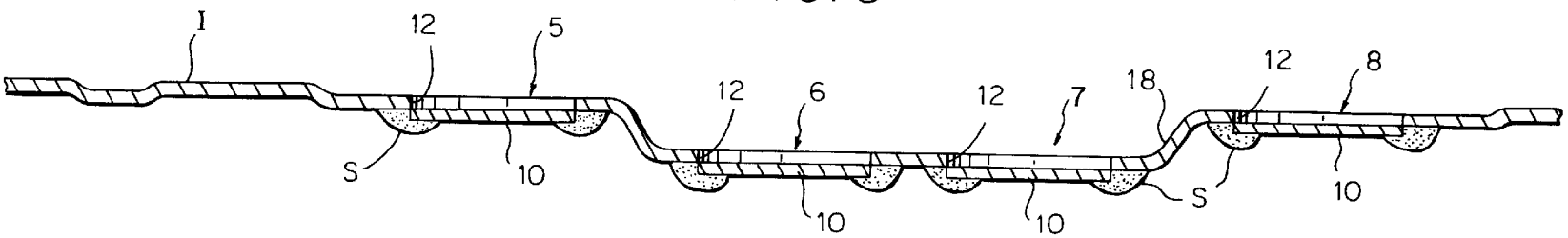
FIG. 6 is a sectional elevation taken along the line A—A in FIG. 5.

In the embodiment shown in FIGS. 5 and 6, a similar array of closures 5 to 8 is formed in the central panel 2 in the manner shown. To facilitate easier location of the prongs P of a fork F in the closures 5 to 8, the innermost closures 6 and 7 are in this embodiment located within a generally oval well 18 formed in the central panel 2, with the outermost closures 5 and 8 remaining in the plane of the central panel 2. In this way, the outermost prongs P of the fork F will engage the outermost closures 5 and 8 first followed by engagement of the innermost closures 6 and 7, thereby avoiding the need for alignment between all prongs P and all closures 5 to 8 at the same time.

Figures 8, 9, 10, 11:
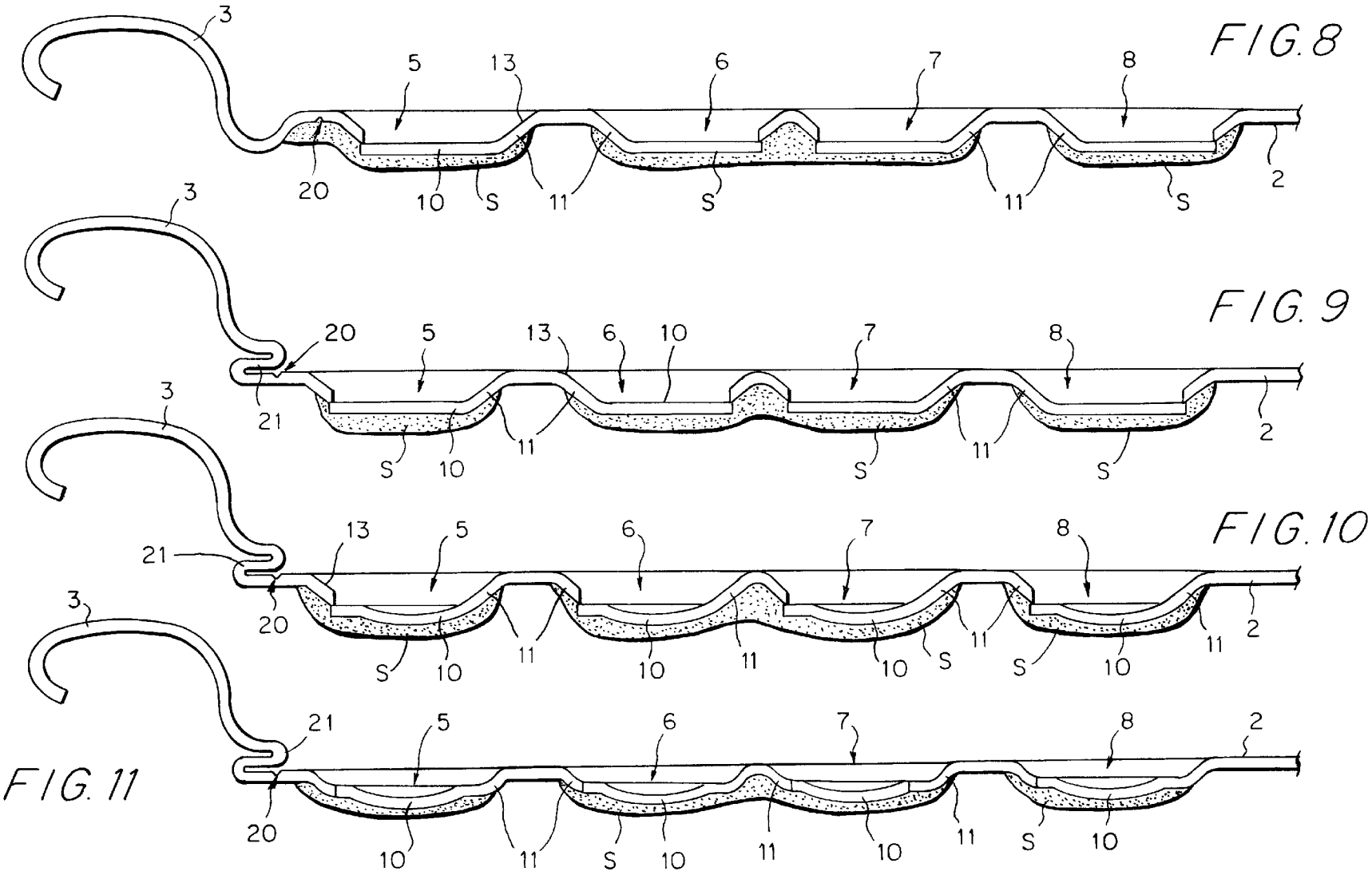
FIGS. 8 to 11 are fragmentary, sectional elevations taken along the line X—X in FIG. 7 showing alternative closure constructions embodying the invention.

Referring now to FIGS. 7 to 11 of the drawings, the pus-in closures 5 to 8 formed in the central panel 2 are in a linear array extending radially of the panel 2 from its centre with the outermost closure 5 being formed adjacent the rim 3. The central panel 2 is defined by a score line 20 formed in a known manner to facilitate removal of the central panel 2 by the prongs of a standard domestic fork engaging the closures 5 to 8. In the embodiment of FIG. 8, the score line 20 is formed in the innermost face of the can end 1, while in FIG. 9, the score line 20 is formed in the outer face of the can end and the severed edge formed when the central panel 2 is removed is protected by a fold 21 formed in the rim 3 in a manner known in the art, and as shown clearly in FIG. 9 of the drawings.

It has been found that by forming the closures in a linear radial array, the removed central panel has a greater tendency to remain on the prongs of the fork as the panel is levered away from the rim 3. Contrary to expectations, the arrangement of the closures 5 to 8 in a linear radial array does not effect the ability of the user to lever the central panel 2 from the rim, and in this regard this embodiment of the invention is equally effective as the previously described embodiments.

The push-in closures 5 to 8 are formed in a manner similar to the previous embodiments, and for this reason the same reference numerals are used to indicate similar features, and in the embodiment of FIGS. 8 and 9, the hinges 11 alternate in direction as shown. A more preferred arrangement is shown in FIG. 10, in which the hinges 11 are in the same direction to ensure a uniform opening force for each closure 5 to 8. In this embodiment, each tab 10 is slightly dished to encourage fork prone location and penetration.

In the embodiment of FIG. 11, the closure tabs 10 are cold worked to be relocated within their openings 12 to provide an indication of tampering in the event that one of the closures 5 to 8 is purposely or inadvertently opened.

We claim:

1. An end panel for a full-open end closure for a container, comprising: a rim portion, a removable central panel portion connected to the rim portion for detachment by means of an opening implement, said central panel portion having a plurality of push-in closure members dimensioned to receive the prongs of an opening implement, each push-in closure member having a tab portion severable from the central panel to create an opening dimensioned to receive the prongs without materially affecting the structural integrity of the end panel under high pressure conditions, means hermetically sealing the tab portions to the central panel portion, said tab portions being displaceable by the prongs of the opening implement to create openings not substantially larger than the prongs of the opening implement to thereby allow firm engagement between the opening implement and said central panel and enable detachment of said central panel portion from said rim portion.

2. The end panel of claim 1 wherein said plurality of push-in closure members are arranged in an array and the closure members are spaced to receive the prongs of the opening implement, wherein said opening implement is a standard domestic fork.

3. The end panel of claim 2, wherein said array of closure members is formed in the central panel portion along an arcuate line corresponding to the curvature of the rim portion.

4. The end panel of claim 2, wherein said array of closure members extends along a radial line from the center of said central panel portion, with one closure member positioned adjacent the rim portion.

5. The end panel of claim 2, wherein each closure member is generally rounded in shape and dimensioned to closely receive one of the prongs of a standard domestic fork.

6. The end panel of claim 2, wherein said array of closure members consists of two outer and two inner closure members, the two inner closure members being located in an oval well formed in the center panel, said inner closure members being dimensioned to receive two prongs of a standard domestic fork.

7. The end panel of claim 1, wherein each tab portion is formed within a centrally downward depressed region defined by a sloping wall surrounding each tab portion to guide the opening implement into engagement with the tab portion.

8. The end panel of claim 7, wherein each tab portion is downwardly sloped to facilitate location and penetration of the prongs of a fork.

9. The end panel of claim 1 wherein said central panel portion is integrally formed with the rim portion for subsequent separation along a score line adjacent said rim portion.

10. The end panel of claim 9, wherein said rim portion is formed with an inwardly folded portion which overlies said score line to protect the severed edge when the central panel portion is removed from said rim portion.

11. The end panel of claim 9 wherein said central panel portion is configured to be at least substantially removed from the rim portion, said central panel being at least substantially severed from said rim portion and having a peripheral free edge portion thereof, said rim portion including a first fold defining an inner free edge portion and a second fold opposite from said first fold, said second fold defining an edge portion which extends in a spaced relationship with said inner free edge portion, the peripheral free edge portion of the central panel being positioned in overlapping relationship with and between said inner free edge portion and a parallel rim portion having an edge, to prevent displacement of said central panel relative to said rim portion during processing and handling, and sealant means for hermetically sealing said peripheral edge portion of said central panel with respect to said rim portion.

12. An end panel for a full-open end closure for a container comprising a rim portion, a removable central panel portion connected to the rim portion for detachment by means of an opening implement, said central panel portion having an array of push-in closure members each dimensioned and spaced to receive small narrow portions of said opening implement, said push-in closure member each comprising a tab portion severable from the central panel to create an opening dimensioned to receive said narrow portions, means hermetically sealing each tab portion to the central panel portion, said tab portions being displaceable by said narrow portions of said opening implement to create an array of openings not substantially larger than said narrow portions of said opening implement to thereby allow firm engagement between said narrow portions of said opening implement and said central panel to enable detachment of said central panel portion from said rim portion by said opening implement.

13. The end panel of claim 3, wherein each closure member is rounded in shape and dimensioned to receive one prong of a standard domestic fork.

14. The end panel of claim 4, wherein each closure member is rounded in shape and dimensioned to receive one prong of a standard domestic fork.

* * * * *